US007543570B2

(12) United States Patent
Bämpfer

(10) Patent No.: US 7,543,570 B2
(45) Date of Patent: Jun. 9, 2009

(54) FEED UNIT

(75) Inventor: Michael Bämpfer, Rotenburg (DE)

(73) Assignee: Siemens Aktiengesellschaft, München (DE)

( * ) Notice: Subject to any disclaimer, the term of this patent is extended or adjusted under 35 U.S.C. 154(b) by 493 days.

(21) Appl. No.: 10/880,194

(22) Filed: Jun. 29, 2004

(65) Prior Publication Data

US 2005/0025639 A1 Feb. 3, 2005

(30) Foreign Application Priority Data

Jul. 9, 2003 (DE) ..... 103 31 025

(51) Int. Cl.
*F02M 37/04* (2006.01)

(52) U.S. Cl. ..... 123/509; 123/495; 417/423.7; 310/72

(58) Field of Classification Search ..... 123/509, 123/495; 417/423.7; 310/72
See application file for complete search history.

(56) References Cited

U.S. PATENT DOCUMENTS 2,590,559 A * 3/1952 Miller ..... 310/71
3,418,991 A * 12/1968 Gelenius et al. ..... 123/179.1
4,550,268 A * 10/1985 Becker et al. ..... 310/239
4,727,274 A * 2/1988 Adam et al. ..... 310/239
4,748,356 A * 5/1988 Okashiro et al. ..... 310/72
5,064,342 A * 11/1991 Iwai ..... 415/55.1
5,102,307 A * 4/1992 Meyer ..... 417/423.7
5,554,010 A 9/1996 Schoedl et al.
6,867,515 B1 * 3/2005 Breynaert ..... 310/51

FOREIGN PATENT DOCUMENTS

DE 43 27 454 A1 2/1995
DE 40 36 754 C2 7/1999
GB 834689 5/1960

OTHER PUBLICATIONS

Patent Absracts of Japan, Publication No. 06205568 A.

* cited by examiner

*Primary Examiner*—Stephen K Cronin
*Assistant Examiner*—J. Page Hufty
(74) *Attorney, Agent, or Firm*—Cohen Pontani Lieberman & Pavane LLP

(57) ABSTRACT

In a feed unit for feeding fuel to an internal combustion engine of a motor vehicle, inductors are arranged on the outer side of a housing component of an electric motor. The inductors are fabricated in one piece with connecting lines and have a large line cross section and therefore a particularly small voltage drop. The housing component is of particularly compact design.

13 Claims, 2 Drawing Sheets

FEED UNIT

BACKGROUND OF THE INVENTION

1. Field of the Invention

The invention relates to a feed unit for feeding fuel from a fuel container of a motor vehicle to an internal combustion engine, having an electric motor, having a housing component of the electric motor, having brushes which are covered by the housing component, having electrical connecting lines which lead to the brushes, and having at least one inductor which is arranged in the connecting lines.

2. Discussion of the Prior Art

Such feed units are known from practice with a physical unit composed of an electric motor which is operated by direct current, and plug-type contacts arranged on the outer side of the housing component, the electrical connecting lines and the inductor. In this context, the housing component usually has guides for the brushes and is connected to further housing components of the electric motor during the mounting operation. After the mounting operation, the electric motor can be connected to a voltage source by means of the plug-type contacts. In the known feed unit, the plug-type contacts are lead through the housing component. The inductors are welded tight to the inner side of the plug-type contacts. As a rule, the plug-type contacts are also connected to one another by means of a capacitor.

A disadvantage with the known feed unit is that the installation space on the inner side of the housing component is highly restricted. The diameter of the housing component is predefined by the diameter of the rest of the housing, while the overall height of the housing component is to be kept as small as possible so that the electric motor can be used in usually low fuel containers. For this reason, in the known feed unit, only very small inductors with low inductance can be used. In addition, owing to the limited space in the housing, the inductors have a small line cross section, which leads to a voltage drop across the inductors.

SUMMARY OF THE INVENTION

The invention is based on the problem of configuring a feed unit of the type mentioned at the beginning in such a way that a voltage drop is kept as small as possible and the housing component has particularly small dimensions.

This problem is solved according to the invention in that the inductor is arranged outside the region of the housing component which covers the brushes.

By means of this configuration, the inductors can have large dimensions, and thus a large inductance, irrespective of the dimensions of the housing component which are to be kept small. Therefore the inductors can also have large line cross sections, which keeps the voltage drop particularly small. Since the inductors are arranged outside the region of the housing component which covers the brushes, the housing component can be of particularly compact construction and therefore have particularly small dimensions. It is generally not necessary to protect the inductors arranged on the outer side of the housing component against corrosion.

Reliable interference suppression of the electric motor can be carried out, according to another advantageous development of the invention, if a capacitor which connects the connecting lines to one another is arranged on the side of the housing component facing away from the inductors. Since the inductors are arranged outside the region of the housing component which covers the brushes, the capacitor has a very large installation space available within the housing, and can accordingly have a high capacitance.

The feed unit according to the invention is of particularly simple construction if the connecting lines are embodied as inductors. As a result, there is no need for any additional welded connections between the inductors and the connecting lines, which leads to a further simplification of the mounting of the inductors. In the simplest case, the connecting lines are wound in the form of a cylindrical coil over an anticipated length.

The electric motor is particularly easy to mount according to another advantageous development of the invention if the housing component is embodied as a holder for the electric motor.

According to another advantageous development of the invention, the inductor is particularly easy to mount if the housing component has, on its outer side, at least one mount for a ferrite core for one of the inductors.

A contribution to further simplifying the mounting of the inductor is made, according to another advantageous development of the invention, if the mount has a cover and if the cover is detachably connected to the housing component. The detachable connection is preferably a latching connection.

BRIEF DESCRIPTION OF THE DRAWINGS

The invention permits numerous embodiments. In order to further simplify its basic principle, two of them are illustrated in the drawing and are described below. In said drawing.

DETAILED DESCRIPTION OF THE PREFERRED EMBODIMENTS

Figure 1:
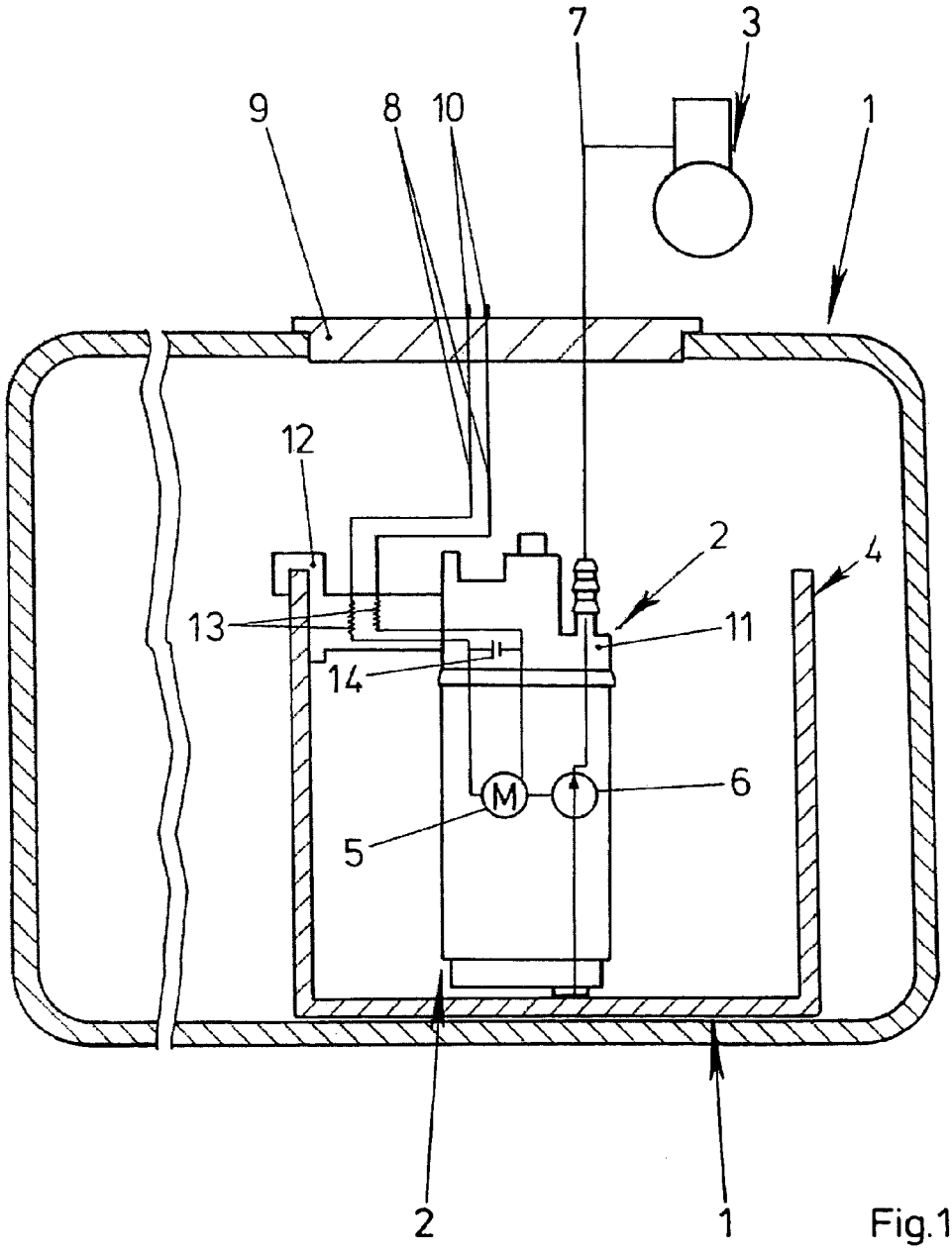
FIG. 1 shows a schematic view of a fuel supply system having a feed unit according to the invention.

FIG. 1 shows a schematic view of a feed unit 2, arranged in a fuel container 1, for supplying an internal combustion engine 3 of a motor vehicle with fuel. The feed unit 2 is arranged in a splash pot 4 and has a fuel pump 6 which is driven by an electric motor 5. A forward flow line 7 which leads to the internal combustion engine 3, and electrical connecting lines 8, are lead through a flange 9 of the fuel container 1. On the outside of the flange 9, the connecting lines 8 each have connecting contacts 10 with which they can be connected to a power supply system (not illustrated) of the motor vehicle. On its upper side, the feed unit 2 has a structural unit composed of the housing component 11 and pump holder 12. The feed unit 2 is connected to the splash pot 4 by means of the pump holder 12. Inductors 13 are arranged in the pump holder 12. Partial regions of the connecting lines 8 which are arranged between the inductors 13 and the electric motor 5 are connected to a capacitor 14. The inductors 13 and the capacitor 14 are used to carry out interference suppression of the electric motor 5.

Figure 2:
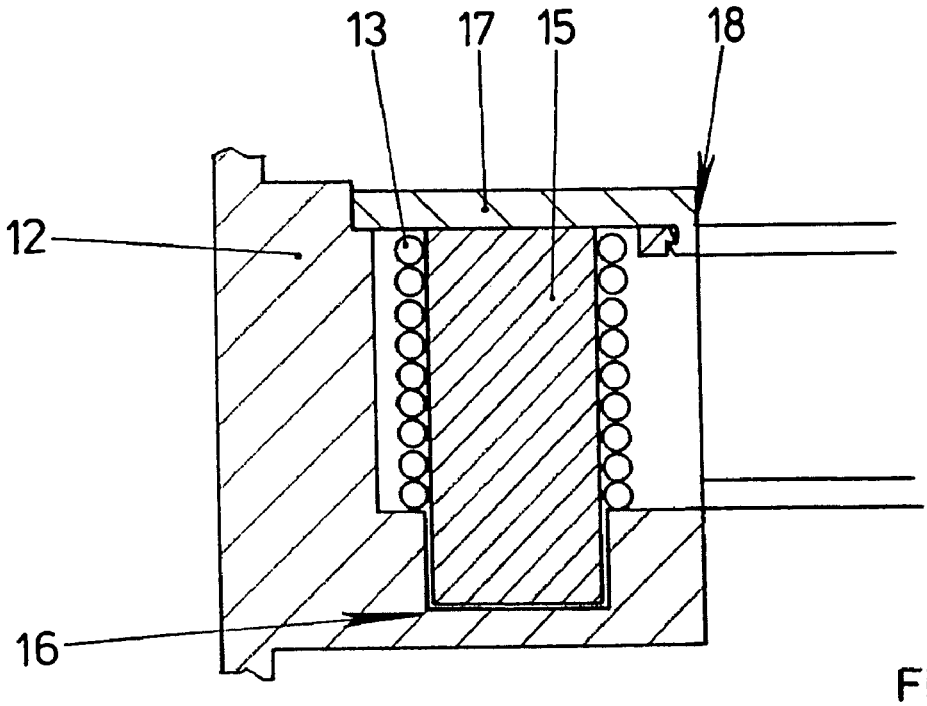
FIG. 2 shows a partial region of a housing component of the feed unit from FIG. 1.

FIG. 2 shows, in a partial section through the pump holder 12 and one of the inductors 13 from FIG. 1, that the inductors 13 have a ferrite core 15 which is inserted in the pump holder 12. The ferrite core 15 is inserted in a mount 16 and is held by a cover 17. The cover 17 has a latching connection 18 to the pump holder 12.

Figure 3:
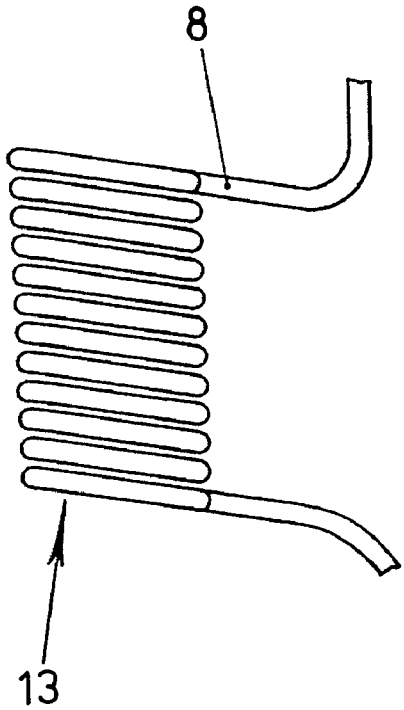
FIG. 3 shows an inductor of the housing component of the feed unit from FIG. 1.

FIG. 3 shows the inductor 13 from FIG. 2 before it is mounted in the pump holder 12 and on the ferrite core 15. It is to be noted here that the inductor 13 is fabricated in one piece with the electrical connecting lines 8 of the electric motor 5 from FIG. 1. The electrical connecting lines 8 are wound to form the inductor 13.

Figure 4:
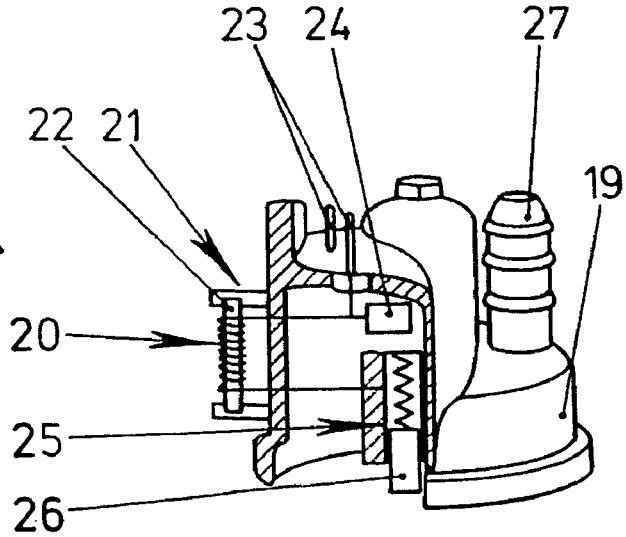
FIG. 4 shows a schematic partial view through a further embodiment of the housing component.

FIG. 4 shows, in a partial section through a housing component 19, the feed unit 2 from FIG. 1, in which an inductor 20 is arranged on the outer side of a housing component 19. The housing component 19 has, on its outer side, a mount 21 for a ferrite core 22 of the inductor 20 and two connecting contacts 23 to which the connecting lines 8 which are illustrated in FIG. 1 can be connected. A capacitor 24 which connects the connecting contacts 23 to one another is arranged on the inner side of the housing component 19. Furthermore, the housing component 19 has a guide 25 for a brush 26 of the electric motor 5 from FIG. 1. The guide 25 is electrically conductively connected to the inductor. A connector element 27 which is arranged on the upper side of the housing component 19 is used to make the connection to the forward flow line 7 which is illustrated in FIG. 1.

The invention claimed is:

1. A feed unit for feeding fuel from a fuel container of a motor vehicle to an internal combustion engine, comprising:

a housing component configured to be disposed inside the fuel container;

an electric motor, a pump, and brushes disposed inside the housing component;

electrical connecting lines leading to the brushes disposed inside the housing component and extending through and beyond an outer side of the housing component; and at least one inductor arranged in the electrical connecting lines and disposed outside of the housing component and exposed to the environment inside the fuel tank;

wherein the inductor is fabricated in one piece with the electrical connecting lines.

2. The feed unit as claimed in claim 1, further comprising a capacitor connecting the electrical connecting lines to one another.

3. The feed unit as claimed in claim 1, wherein the connecting lines comprise inductors.

4. The feed unit as claimed in claim 1, wherein the housing component is a holder for the electric motor.

5. The feed unit as claimed in claim 1, wherein the housing component comprises, on the outer side, at least one mount for a ferrite core for the at least one inductor.

6. The feed unit as claimed in claim 5, wherein the at least one mount comprises a cover detachably connected to the housing component.

7. The feed unit as claimed in claim 2, wherein the connecting lines comprise inductors.

8. The feed unit as claimed in claim 2, wherein the housing component is a holder for the electric motor.

9. The feed unit as claimed in claim 2, wherein the housing component comprises, on the outer side, at least one mount for a ferrite core for the at least one inductor.

10. The feed unit as claimed in claim 9, wherein the at least one mount comprises a cover detachably connected to the housing component.

11. The feed unit as claimed in claim 3, wherein the housing component is a holder for the electric motor.

12. The feed unit as claimed in claim 3, wherein the housing component comprises, on the outer side, at least one mount for a ferrite core for the at least one inductor.

13. The feed unit as claimed in claim 12, wherein the at least one mount comprises a cover detachably connected to the housing component.

* * * * *